US008517849B2

(12) United States Patent
Tuckey

(10) Patent No.: US 8,517,849 B2
(45) Date of Patent: Aug. 27, 2013

(54) INFANT SWING APPARATUS

(75) Inventor: Peter R. Tuckey, Morgantown, PA (US)

(73) Assignee: Wonderland Nurserygoods Company Limited, Hong Kong (HK)

( * ) Notice: Subject to any disclaimer, the term of this patent is extended or adjusted under 35 U.S.C. 154(b) by 278 days.

(21) Appl. No.: 13/022,798

(22) Filed: Feb. 8, 2011

(65) Prior Publication Data

US 2011/0207541 A1 Aug. 25, 2011

Related U.S. Application Data

(60) Provisional application No. 61/338,535, filed on Feb. 19, 2010.

(51) Int. Cl.
*A63G 9/16* (2006.01)
*A63G 9/00* (2006.01)

(52) U.S. Cl.
USPC ..... 472/119; 340/671

(58) Field of Classification Search
USPC ..... 472/118–125; 340/671, 672, 686.2, 340/686.3
See application file for complete search history.

(56) References Cited

U.S. PATENT DOCUMENTS 6,339,304 B1 1/2002 Allison et al.
7,905,791 B2 * 3/2011 Guang et al. ..... 472/119

FOREIGN PATENT DOCUMENTS

JP 11511659 10/1999

* cited by examiner

*Primary Examiner* — Kien Nguyen
(74) *Attorney, Agent, or Firm* — Baker & McKenzie LLP

(57) ABSTRACT

An infant swing apparatus comprises a first pivot shaft coupled with a swing arm, a motorized drive unit configured to drive rotation of the first pivot shaft in alternate directions, and a swing motion sensing unit including an encoder wheel securely mounted with a second pivot shaft. The second pivot shaft is directly coupled with the first pivot shaft in angular displacement via frictional interaction. As a result, the rotation of the first pivot shaft and corresponding swing motion can monitored in a precise manner.

22 Claims, 5 Drawing Sheets

INFANT SWING APPARATUS

CROSS-REFERENCE TO RELATED APPLICATION(S)

This non-provisional patent application claims priority to U.S. Provisional Patent Application No. 61/338,535, which was filed on Feb. 19, 2010.

BACKGROUND

1. Field of the Invention

The present invention relates to an infant swing apparatus, and more particularly to a motor-driven swing apparatus.

2. Description of the Related Art

Caregivers usually rely on a swing apparatus to facilitate the care of an infant or young child. The swing apparatus can be used to provide a comfortable, safe and entertaining environment to the child. Conventionally, a swing apparatus is made up of a seat that can securely hold the child, and a frame having swing arms from which the seat is suspended. The swing arms are pivotally connected to the frame so as to be able to swing the seat back and forth.

A conventional drive system of the infant swing utilizes a gear reduction system that is coupled between an electric motor and a pivot shaft of the swing arm. More specifically, a control voltage is usually applied to the motor so as to drive it in the correct direction and at the correct velocity and torque. In turn, the gear reduction system can change the high speed and low torque of the motor into a rotation and torque capable of swinging the seat in a pendulum motion. In order to properly reverse the swing motion, a sensing device is used to determine the swing speed and amplitude. For this purpose, an infrared or other sensing device can be provided to monitor the rotation of an encoder wheel mounted on the motor shaft. As the swing motion approaches a speed of zero and then accelerates in the opposing direction, the encoder wheel can exhibit a corresponding change.

A problem with the aforementioned design is that the gear box typically has multiple gear stages for applying the correct reduction. Each of these stages introduces some backlash into the drive system. In particular, the backlash can create a situation where the swing motion has changed direction, but the change in direction is not instantaneously captured by a change in direction of the encoder wheel. Since the swing motion is continually changing directions, this issue can result in an incorrect determination of the swing amplitude and/or change in direction. Therefore, driving signals may be incorrectly applied to the electric motor.

Therefore, there is a need for an improved swing apparatus that can drive swing motion in a more accurate and efficient manner, and address at least the foregoing issues.

SUMMARY

The present application describes a swing apparatus that can overcome the foregoing issues, and drive swing motion in a more accurate and efficient manner.

In one embodiment, the infant swing apparatus comprises a support frame, a swing arm coupled with the support frame via a first pivot shaft, a motorized drive unit configured to drive rotation of the first pivot shaft, and a swing motion sensing unit including an encoder wheel securely mounted with a second pivot shaft, wherein the second pivot shaft is operatively driven in rotation by the first pivot shaft.

According to another embodiment, the infant swing apparatus comprises a first pivot shaft coupled with a swing arm, a motorized drive unit configured to drive rotation of the first pivot shaft in alternated directions, and a swing motion sensing unit including an encoder wheel securely mounted with a second pivot shaft, wherein the second pivot shaft is directly coupled with the first pivot shaft in angular displacement via a friction interaction.

At least one advantage of the infant swing apparatus described herein is the ability to provide a swing motion sensing unit that can directly couple with the pivot shaft of the swing arm in angular displacement without intermediate movement transmission elements (such as gears). Because the pivot shaft of the encoder wheel is operatively independent from the drive unit, the measure provided from the encoder wheel is not affected by internal backlashes occurring in the drive unit.

DETAILED DESCRIPTION OF THE EMBODIMENTS

The present application describes an infant swing apparatus that is operated by a motorized drive system. The swing apparatus can comprise a first pivot shaft coupled with a swing arm, a motorized drive unit configured to drive rotation of the first pivot shaft in alternated directions, and a swing motion sensing unit including an encoder wheel securely mounted with a second pivot shaft. The second pivot shaft is directly coupled with the first pivot shaft in angular displacement via static frictional interaction. As a result, the rotation of the first pivot shaft and corresponding swing motion can monitored in a precise manner.

Figure 1:
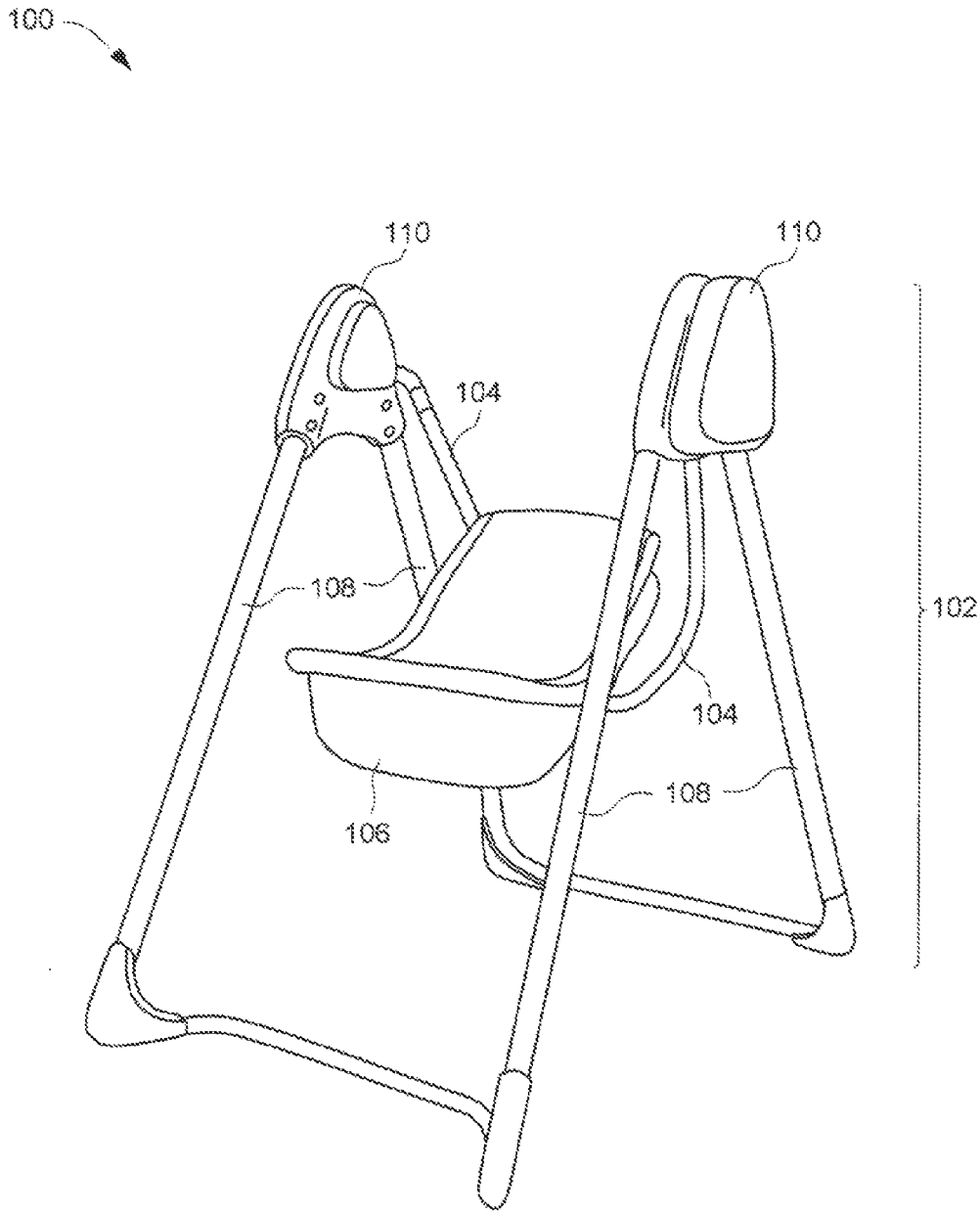
FIG. 1 is a perspective view illustrating one embodiment of an infant swing apparatus.

FIG. 1 is a perspective view illustrating one embodiment of a swing apparatus 100. The swing apparatus 100 can comprise a support frame 102, swing arms 104 pivotally coupled with the support frame 102, and an infant support 106 connected with the swing arms 104. The support frame 102 can include a plurality of legs 108 that are respectively provided on left and right sides of the infant support 106, and are upwardly joined with a housing 110. Each of the swing arms 104 has an upper end pivotally coupled with the housing 110, and a lower end coupled with one (i.e., left/right) side of the infant support 106. Examples of the infant support 106 can include a seat adapted to receive a child in a sitting position. One of the two housings 110 can enclose a swing drive system 200 (shown in FIG. 2A) adapted to drive pendulum movements of the swing arms 104.

Figure 2A:
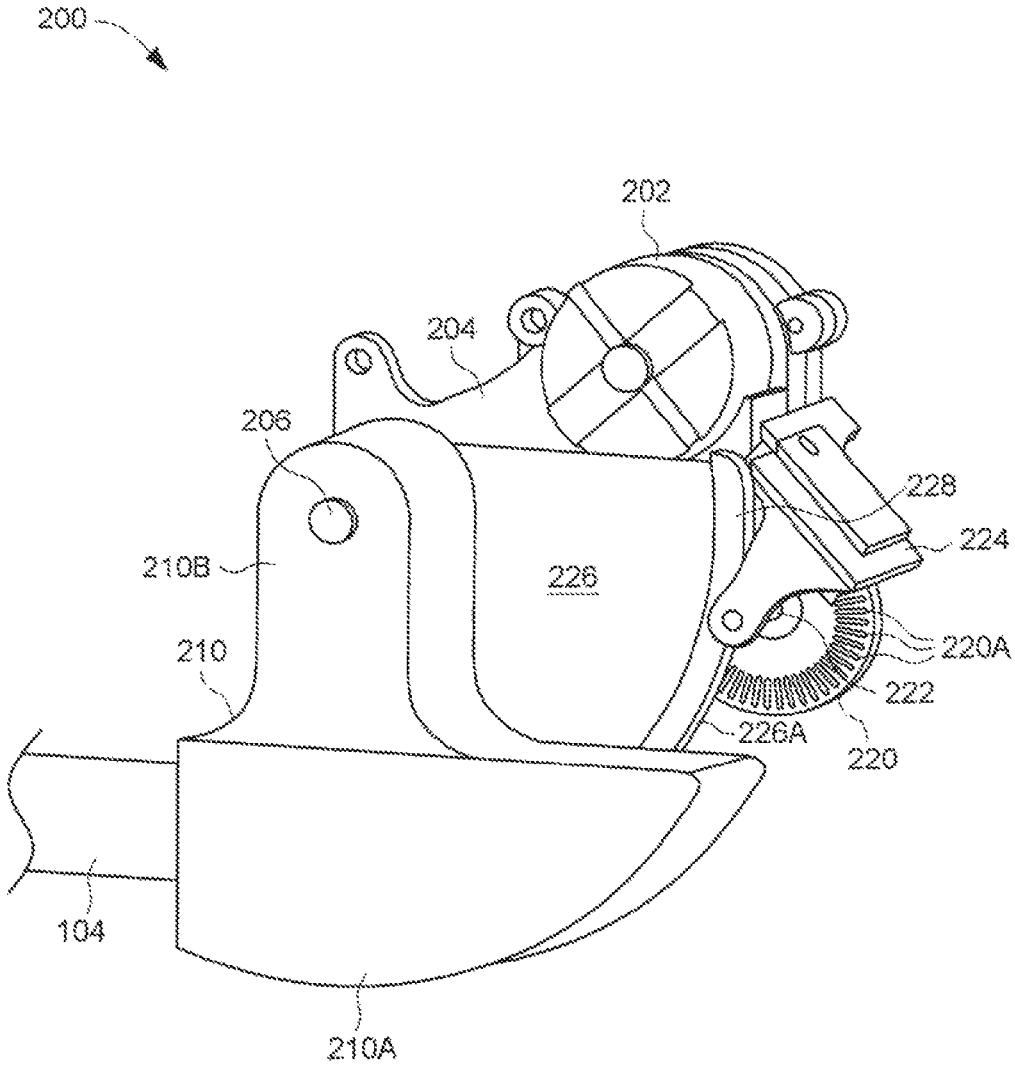
FIG. 2A is a schematic view illustrating one embodiment of a swing drive system.

FIG. 2A is a schematic view illustrating one embodiment of the swing drive system 200. The swing drive system 200 can include an electric motor 202, a gear box 204, and a first pivot shaft 206. Examples of the electric motor 202 can include DC motors that may be controlled by a pulse width modulation (PWM) controller. The gear box 204 can include transmission elements adapted to reduce the output of the electric motor 202 (e.g., velocity and torque at the motor output shaft), and transmit the adapted motor output to the first pivot shaft 206. Examples of components assembled in the gear box 204 can include various types of gear sets, such as worm gear, planetary gears, etc. The first pivot shaft 206 is coupled with one swing arm 104 via a coupling element 210, such that rotation of the first pivot shaft 206 can cause corresponding angular movement of the swing arm 104.

In one embodiment, the coupling element 210 can have a shoe shape with a hollow first portion 210A fixedly secured with the distal end of the swing arm 104, and a second portion 210B provided with a hole through which the first pivot shaft 206 may be affixed. In one embodiment, the coupling element 210, including the first and second portions 210A and 210B, can be formed in a single body such as plastics molding.

Referring again to FIG. 2A, in order to control the velocity and angular displacement of the swing arm 104, an encoder wheel 220 may be operatively coupled with one of the first pivot shaft 206, the coupling element 210 and the swing arm 104 to monitor the movement of the infant support 106. In particular, the encoder wheel 220 can be securely mounted with a second pivot shaft 222 that is assembled with the housing 110 at a position spaced apart from the first pivot shaft 206. The second pivot shaft 222 is positioned independently apart from the gear box 204 and the gear motor 202 in the movement transmission chain for driving the first pivot shaft 206. More specifically, the second pivot shaft 222 is placed at a downstream position from the swing driving chain closed by the swing arm 104, rather than being coupled with the driving source, i.e., the electric motor 202. In one embodiment, the second pivot shaft 222 can have a diameter that is smaller than the diameter of the first pivot shaft 206.

The encoder wheel 220 can include a plurality of slits 220A distributed in an annular array centered on the second pivot shaft 222. When the rotating first pivot shaft 206 drives the second pivot shaft 222 and the encoder wheel 220 in synchronous rotation, the slits 220A may pass by a sensor 224 (for example, infrared or other types of sensors), whereby the angular displacement and velocity of the encoder wheel 220 can be measured. Because the movement of the encoder wheel 220 is synchronously coupled with the movement of the first pivot shaft 206, the angular displacement and velocity of the first pivot shaft 206 (and swing arm 104) can be derived from the displacement and velocity information of the encoder wheel 220.

As shown, the second pivot shaft 222 is independent from the drive unit comprised of the motor 202 and the gear box 204, i.e., the second pivot shaft 222 is operatively disconnected from the drive unit. As a result, the measure of rotation provided from the encoder wheel 220 is not affected by internal backlashes that may occur in the drive unit. Any change in the direction of rotation of the first pivot shaft 206 can accordingly result in an instantaneous change in the direction of rotation of the second pivot shaft 222 and encoder wheel 220.

Figure 2B:
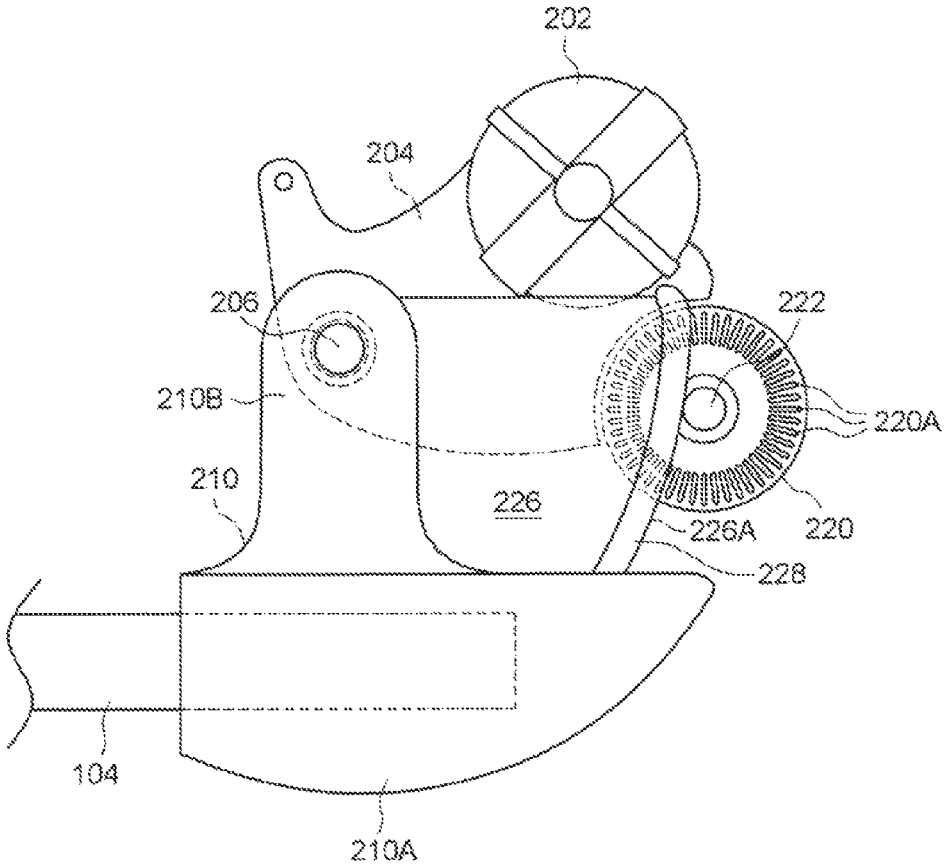
FIG. 2B is a schematic view illustrating the friction engagement implemented for converting an angular displacement of a pivot shaft of a swing arm into a rotation of an encoder wheel.

In conjunction with FIG. 2A, FIG. 2B is a schematic view illustrating the friction engagement applied for converting an angular displacement of the first pivot shaft 206 into a rotation of the encoder wheel 220. For clarity, the sensor 224 is omitted in FIG. 2B. As shown, the coupling element 210 can include a radial portion 226 that is approximately centered on the axis of the first pivot shaft 206. The radial portion 226 can be integrally formed with the coupling element 210 at a location adjacent to the first and second portion 210A and 210B. A peripheral edge surface 226A of the radial portion 226 having an arc shape can be in frictional contact with an outer circular surface of the second pivot shaft 222. In this manner, the first pivot shaft 206 can be mechanically directly coupled with the second pivot shaft 222 in angular or rotational displacement.

In one embodiment, a strip of friction-promoting material 228 can be attached on the periphery of the radial portion 226 to form the peripheral edge surface 226A. This material may be selected so as to provide a desirable static coefficient of friction with respect to the second pivot shaft 222, such that the second pivot shaft 222 can be driven in rotation by the first pivot shaft 206 with no occurrence of sliding. In one embodiment where the second pivot shaft 222 is made of rigid plastics, examples of the static friction-promoting material 228 can include thermoplastic elastomers such as rubber.

It is worth noting that other constructions may be adequate to implement a frictional engagement between the first and second pivot shaft 206 and 222. For example, in alternate embodiments, a transmission belt or like parts may be wrapped around the first and second pivot shafts 206 and 222. With this construction, the first and second pivot shafts 206 and 222 can synchronously rotate in a same direction by static friction contact with the transmission belt.

Referring again to FIGS. 2A and 2B, driven by the motor 202, the first pivot shaft 206 and the coupling element 210 can rotate to cause swinging motion of the swing arm 104. Owing to the static frictional contact between the radial portion 226 of the coupling element 210 and the second pivot shaft 222, the second pivot shaft 222 and the encoder wheel 220 are also driven in synchronous rotation in a direction that is opposite to that of the first pivot shaft 206. By detecting and counting the slits 220A of the encoder wheel 220 that pass through the sensor 224, the rotation of the encoder wheel 220 can be monitored to derive the angular displacement and velocity of the swing arm 104, and proper control signals can be issued to control the motor 202.

Figure 3:
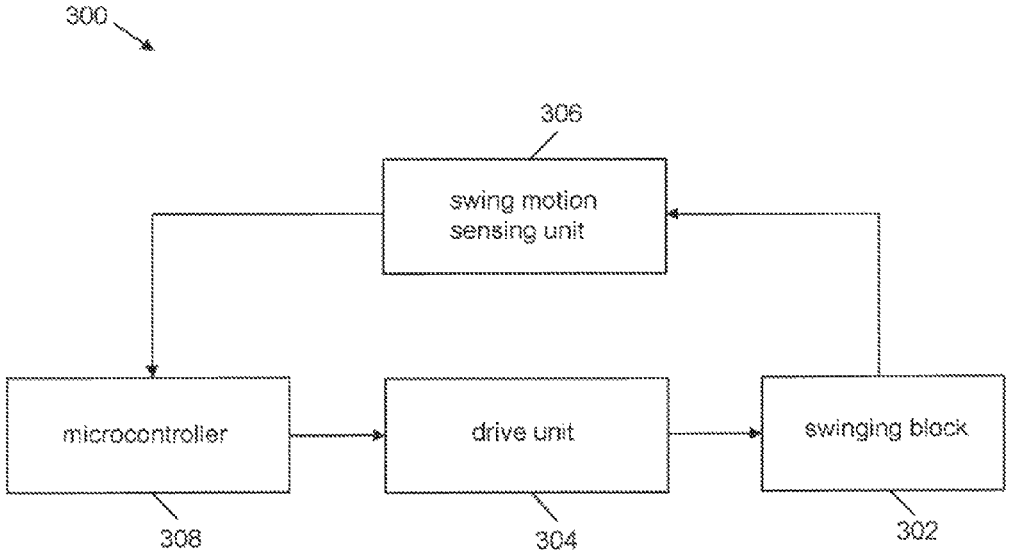
FIG. 3 is a simplified diagram illustrating a swing control system.

FIG. 3 is a simplified block diagram illustrating one embodiment of a swing control system 300 that may be implemented in the swing apparatus 100. The swing control system 300 can include a swinging block 302, a drive unit 304, a swing motion sensing unit 306 and a microcontroller 308. The swinging block 302 can include the first pivot shaft 206, swing arm 104 and other elements held and movable with the swing arm 104 and first pivot shaft 206. The drive unit 304 can include the electric motor 202 and gear box 204 described previously that can drive rotation of the first pivot shaft 206 to cause swinging motion of the swing arm 104. The swing motion sensing unit 306 can include the aforementioned encoder wheel 220, second pivot shaft 222 and sensor 224 used to measure angular displacement and velocity information of the swing arm 104. The microcontroller 308 can be an integrated circuit (IC) processor unit adapted to receive signals from the swing motion sensing unit 306 conveying information related to the rotational displacement of the encoder wheel 220. Based on this information, the microcontroller 308 can derive an angular displacement and other information associated with the first pivot shaft 206 and swing arm 104, and output control signals to the drive unit 304 to control the direction of rotation, torque and velocity of the motor 202.

Figure 4:
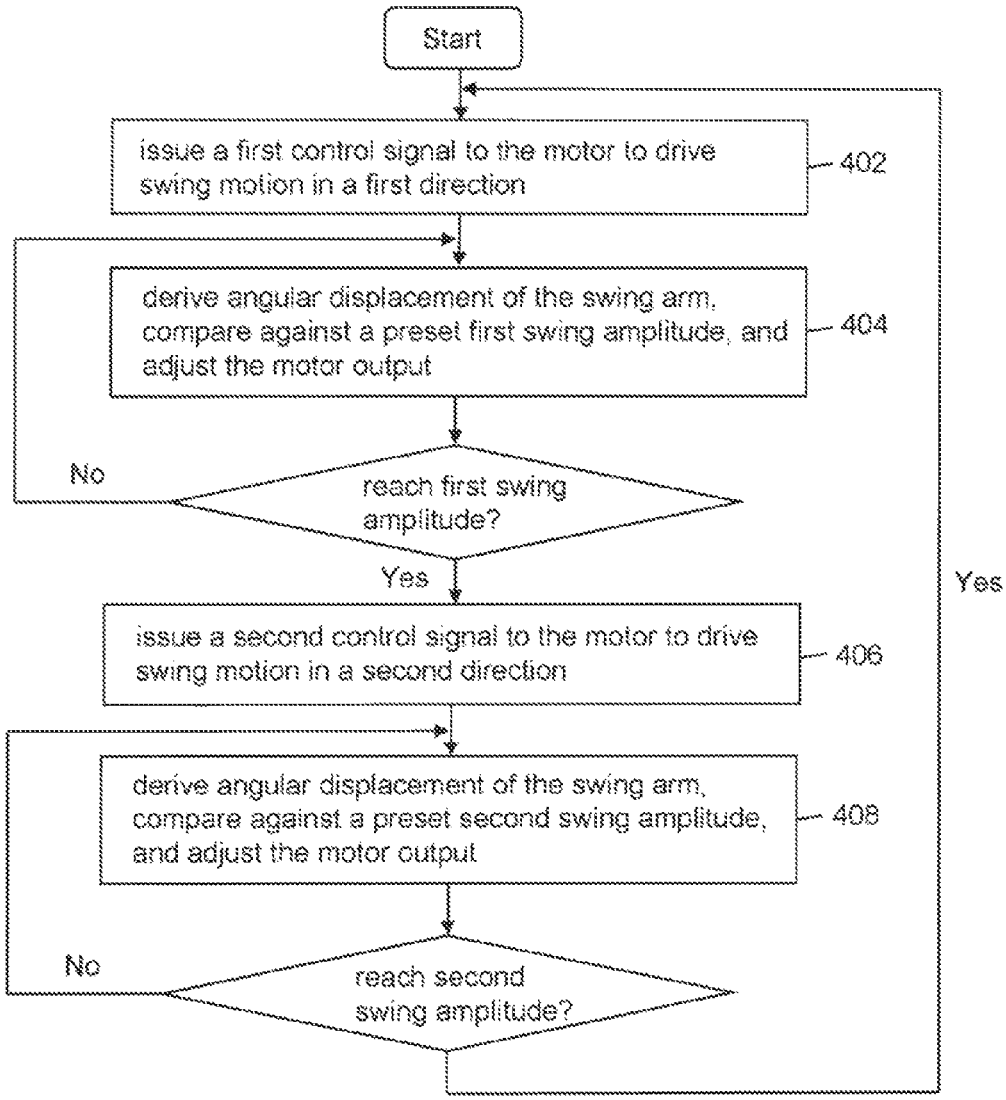
FIG. 4 is a flowchart of method steps implemented to control swing motion of the infant swing apparatus.

FIG. 4 is a flowchart of exemplary method steps implemented to control the swing motion of the swing apparatus. In step 402, the drive unit 304 is activated, and a first control signal (for example, pulse-width modulation (PWM) signal) is supplied to the motor 202 to drive swing motion in a first direction. In step 404, as the motor 202 rotates in the first direction, the microcontroller 308 can receive a signal from the swing motion sensing unit 306, derive a current angular displacement of the first pivot shaft 206 and swing arm 104, compare the current angular displacement against a preset first swing amplitude, and accordingly issue a control signal to adjust the output of the motor 202. Step 404 may be repeated as long as the first swing amplitude is not reached. In step 406, when the angular displacement of the swing arm 104 reaches the first swing amplitude, the microcontroller 208 can supply a second control signal to the motor 202 to change and reverse the swing motion in a second direction. In step 408, as the motor 202 rotates in the second direction, the microcontroller 308 can receive a signal from the swing motion sensing unit 306, derive a current angular displacement of the swing arm 104, compare the current angular displacement against a preset second swing amplitude, and accordingly issue a control signal to adjust the velocity of the motor 202. Step 408 may be repeated as long as the second swing amplitude is not reached. When the second swing amplitude is reached, the method can loop to step 402 to reverse again the direction of the swing motion.

At least one advantage of the infant swing apparatus described herein is the ability to provide a swing motion sensing unit that can directly couple with the pivot shaft of the swing arm in angular displacement without interference of intermediate movement transmission elements (such as gears). Because the pivot shaft of the encoder wheel is operatively independent from the drive unit, the measure provided from the encoder wheel is not affected by internal backlashes occurring in the drive unit. Accordingly, the swing motion can be controlled in a more accurate and efficient manner.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. An infant swing apparatus comprising:

a support frame;

a swing arm coupled with the support frame via a first pivot shaft;

a motorized drive unit configured to drive rotation of the first pivot shaft; and a swing motion sensing unit, including an encoder wheel securely mounted with a second pivot shaft, wherein the second pivot shaft is operatively driven in rotation by the first pivot shaft, and an angular displacement of the first pivot shaft drives the second pivot shaft in synchronous rotation via a mechanical engagement with the second pivot shaft.

2. The infant swing apparatus according to claim 1, wherein the second pivot shaft is disconnected from the drive unit and driven directly by the first pivot shaft.

3. The infant swing apparatus according to claim 1, wherein the first pivot shaft is mounted with a coupling element that rotates along with the first pivot shaft, the coupling element being in frictional contact with the second pivot shaft.

4. The infant swing apparatus according to claim 3, wherein rotation of the first pivot shaft causes rotation of the second pivot shaft in a reverse direction.

5. The infant swing apparatus according to claim 3, wherein the coupling element includes a radial portion that is centered on the first pivot shaft, the radial portion having a peripheral edge surface that is in frictional contact with an outer circular surface of the second pivot shaft.

6. The swing apparatus according to claim 5, wherein the peripheral edge surface is made of a rubber-like material.

7. The infant swing apparatus according to claim 3, wherein the swing arm has a distal end fixedly secured with the coupling element.

8. The infant swing apparatus according to claim 1, wherein the second pivot shaft has a diameter that is smaller than a diameter of the first pivot shaft.

9. The infant swing apparatus according to claim 1, further comprising a microcontroller configured to derive an angular displacement of the swing arm from a rotation of the encoder wheel.

10. The infant swing apparatus according to claim 1, wherein the drive unit includes a motor, and a gear box adapted to reduce an output of the motor for transmission to the first pivot shaft.

11. An infant swing apparatus comprising:

a first pivot shaft coupled with a swing arm;

a motorized drive unit configured to drive rotation of the first pivot shaft in alternate directions;

a swing motion sensing unit, including an encoder wheel securely mounted with a second pivot shaft, wherein the second pivot shaft is directly coupled with the first pivot shaft in angular displacement via a friction interaction.

12. The infant swing apparatus according to claim 11, wherein the second pivot shaft is disconnected from the drive unit.

13. The infant swing apparatus according to claim 11, wherein the first pivot shaft is mounted with a coupling element that rotates along with the first pivot shaft, the coupling element being in frictional interaction contact with the second pivot shaft.

14. The infant swing apparatus according to claim 13, wherein rotation of the first pivot shaft causes rotation of the second pivot shaft in a reverse direction.

15. The infant swing apparatus according to claim 13, wherein the coupling element includes a radial portion that is centered on the first pivot shaft, the radial portion having a peripheral edge surface that is in frictional contact with an outer circular surface of the second pivot shaft.

16. The swing apparatus according to claim 15, wherein the peripheral edge surface is made of a rubber-like material.

17. The infant swing apparatus according to claim 13, wherein the swing arm has a distal end fixedly secured with the coupling element.

18. The infant swing apparatus according to claim 11, further comprising a microcontroller configured to derive an angular displacement of the swing arm from a rotation of the encoder wheel.

19. The infant swing apparatus according to claim 11, wherein the drive unit includes a motor, and a gear box adapted to reduce an output of the motor for transmission to the first pivot shaft.

20. An infant swing apparatus comprising:

a support frame;

a swing arm coupled with the support frame and operable to rotate relative to the support frame about a first pivot axis;

a coupling member assembled with the swing arm and rotatable with the swing arm about the first pivot axis;

a motorized drive unit configured to drive rotation of the swing arm; and a swing motion sensing unit, including an encoder wheel securely mounted with a pivot shaft that defines a second pivot axis radially spaced apart from the first pivot axis, wherein the pivot shaft is in contact with the coupling member, and an angular displacement of the coupling member about the first pivot axis drives the pivot shaft in synchronous rotation about the second pivot axis.

21. The infant swing apparatus according to claim 20, wherein the coupling element includes a radial portion that is centered on the first pivot axis, the radial portion having a peripheral edge surface that is in frictional contact with an outer circular surface of the pivot shaft.

22. The infant swing apparatus according to claim 20, wherein the swing arm has a distal end fixedly secured with the coupling element.

* * * * *